United States Patent [19]

Rivers, Jr. et al.

[11] 4,055,941

[45] Nov. 1, 1977

[54] INTEGRATED STRING

[75] Inventors: Joseph Tracy Rivers, Jr., West Chester, Pa.; Joe Dennis Zaharko, Wilmington, Del.

[73] Assignee: E. I. Du Pont de Nemours and Company, Wilmington, Del.

[21] Appl. No.: 748,883

[22] Filed: Dec. 9, 1976

[51] Int. Cl.[2] ..... D02G 3/34; D02G 3/38; D02G 3/40

[52] U.S. Cl. ..... 57/149; 57/140 J; 57/153; 428/397

[58] Field of Search ..... 57/7, 9, 139, 140 R, 57/140 C, 140 J, 144, 149, 153, 156, 157 R, 162, 164; 428/374, 375, 392, 394, 395, 397, 401

[56] References Cited

U.S. PATENT DOCUMENTS

| | | | |
|---|---|---|---|
| 2,055,776 | 9/1936 | Saladino | 57/153 X |
| 2,401,291 | 5/1946 | Smith | 57/153 X |
| 2,428,046 | 9/1947 | Sisson et al. | 428/397 X |
| 2,815,532 | 12/1957 | Braunlich | 57/140 J X |
| 3,041,915 | 7/1962 | Ryffel | 428/397 X |
| 3,347,036 | 10/1967 | Daniel | 428/397 X |
| 3,365,873 | 1/1968 | Matsumoto et al. | 57/140 J |
| 3,738,096 | 6/1973 | Crandall | 57/149 |
| 3,745,061 | 7/1973 | Champaneria et al. | 57/140 J X |

FOREIGN PATENT DOCUMENTS

| | | | |
|---|---|---|---|
| 34,739 | 8/1905 | Germany | 57/153 |
| 1,101,384 | 1/1968 | United Kingdom | 57/153 |

*Primary Examiner*—Donald Watkins

[57] ABSTRACT

A string suitable for use in game rackets such as for tennis contains from two to four heavy denier monofilaments of an oriented synthetic polymer. Each monofilament has at least two opposite flattened sides throughout its length. The monofilaments are ply-twisted and bonded together along their lengths with each being bonded along a flattened side to at least one other such monofilament. Particularly suitable monofilaments have a substantially ribbon-shaped cross-section with a length-to-width ratio of from two to four.

10 Claims, 4 Drawing Figures

INTEGRATED STRING

BACKGROUND OF THE INVENTION

1. Field of the Invention

This invention concerns strings particularly suitable for use in game rackets such as tennis and squash. More particularly, the strings are comprised of large monofilaments which are ply-twisted and bonded together.

2. Description of the Prior Art

Racket strings made of synthetic monofilaments in a wide variety of constructions are commercially available. A rather common construction is one having a very large central monofilament completely surrounded by a spiral wrapping of one or two layers of many smaller monofilaments, for example, from 11 to 35 or more of the smaller monofilaments. Another type of known string construction is represented by Crandall in U.S. Pat. No. 3,738,096 which discloses a string formed from three strands which have been twisted individually in the first direction and ply-twisted in the opposite direction and coated with a plastic material. The resulting undulating string surface is taught to impart more effective spin to the ball when struck with the racket.

In spite of many available strings of synthetic filaments, many top ranking players still prefer the playing properties of strings made from natural gut, for example, from twisted bundles of fine strips of sheep gut, even though they tend to be less durable than strings of synthetic filaments. Consequently, there is a continuing need for new and improved racket strings made from synthetic filaments.

SUMMARY OF THE INVENTION

The product of this invention is an integrated string comprised of from two to four monofilaments of an oriented synthetic, thermoplastic polymer, with each monofilament having a denier of from 2,000 to 8,000 and having at least two opposite flattened sides throughout its length, the monofilaments having substantially no individual twist and being ply-twisted and bonded together throughout the length of the string with each being bonded along a flattened side to at least one other of said monofilaments.

Preferred monofilaments have a substantially uniform, ribbon-like or so-called obround, cross-section along the monofilament with two opposite flattened sides and a length-to-width ratio of from 2 to 4.

Although strings of this invention may also contain other materials, it is preferred that they consist essentially of 2 to 4 of the above monofilaments and less than about 35% by weight of the bonding agent allowing only for a small amount of other material, such as a color coded filament, which does not significantly affect the overall string properties.

DETAILED DESCRIPTION OF THE DRAWINGS

Figure 1:
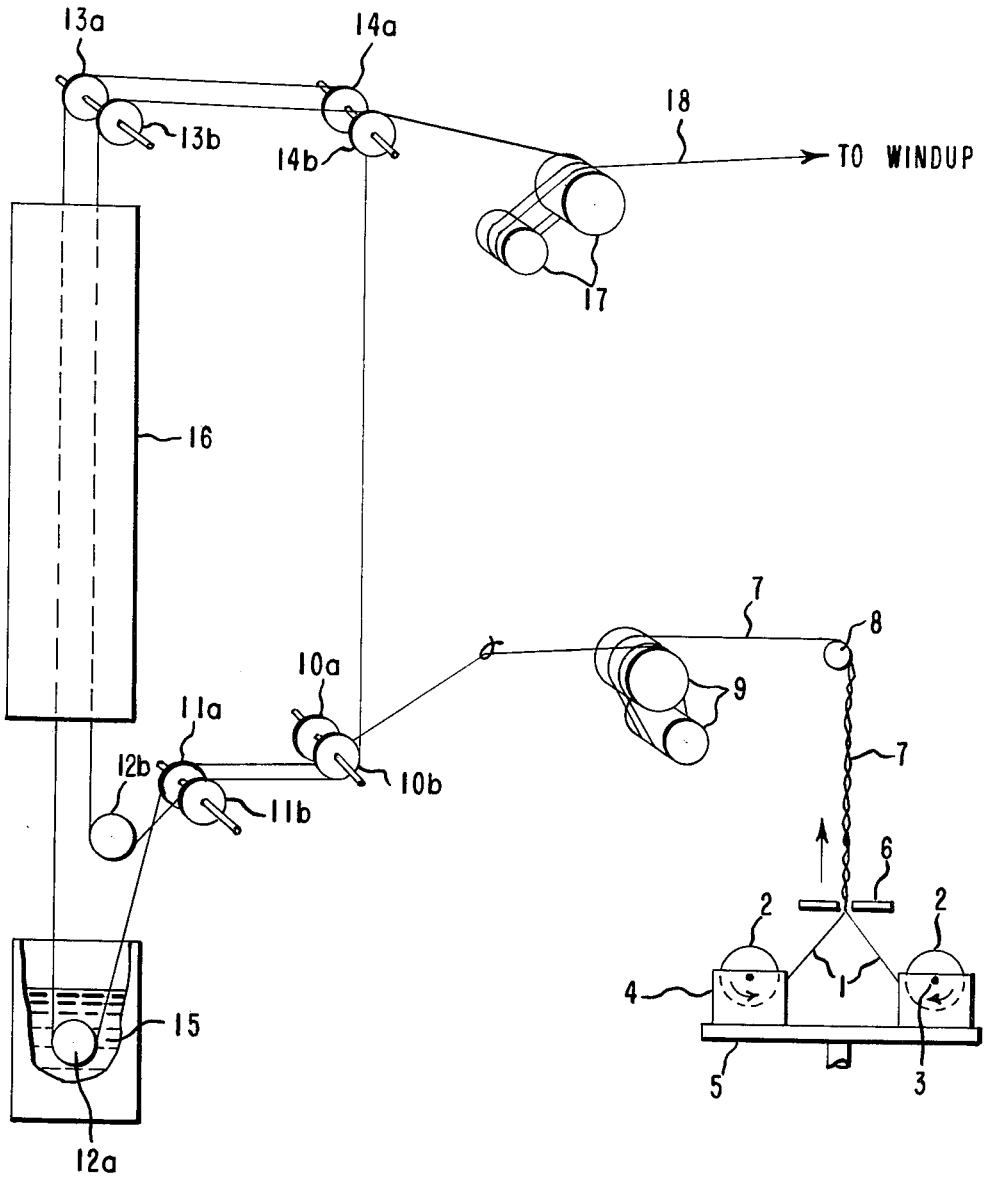
FIG. 1 is a schematic representation of an apparatus suitable for preparing strings of this invention.

In FIG. 1, untwisted monofilaments 1 of the desired cross-section are fed from packages 2 mounted upon spring-tensioned axles 3 on let-off stands 4, fixed upon turntable 5. With the turntable rotating (means not shown), the monofilaments are pulled upward as indicated by the directional arrow through guide 6 to combine them into a ply-twisted string 7, which is passed around guide roll 8 and then around a pair of input rolls 9, several turns being taken around these rolls to avoid slippage. The ply-twisted string is next led through a fixed path for bonding by guides and various spacer rolls, each roll mounted for free individual rotation and designated by numerals 10 through 14. More specifically, the ply-twisted string first passes in contact with rolls **10*a* and 11*a*, is optionally immersed in a bath 15 of adhesive while passing under roll 12*a*, and is then pulled vertically through curing furnace 16. After passing over rolls 13*a* and 14*a*, the string is returned through the furnace without application of adhesive by passage in contact with rolls 10*b*, 11*b*, 12*b*, 13*b* and 14*b*, whereupon it is passed around a pair of exit rolls 17 and the finished ply-twisted, bonded string 18** is then forwarded to a windup (not shown). Obviously, additional spacer rolls may be employed and the string may be passed through the furnace as many times as desired with or without application of adhesive, before or after the string first enters the furnace.

Figure 2:
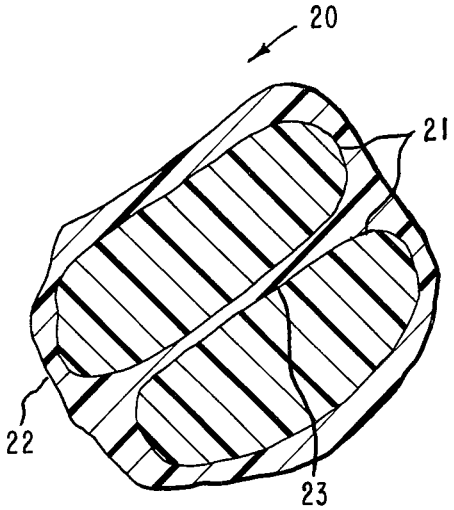
FIGS. 2, 3 and 4 represent cross-sectional views of preferred strings of the invention containing 2, 3 and 4 monofilaments, respectively.
Figure 3:
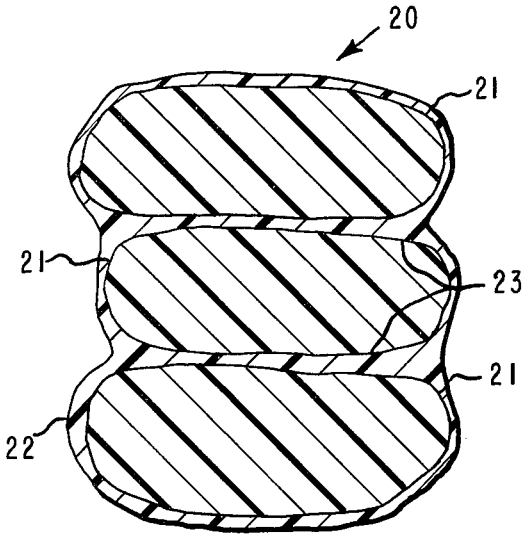
Figure 4:
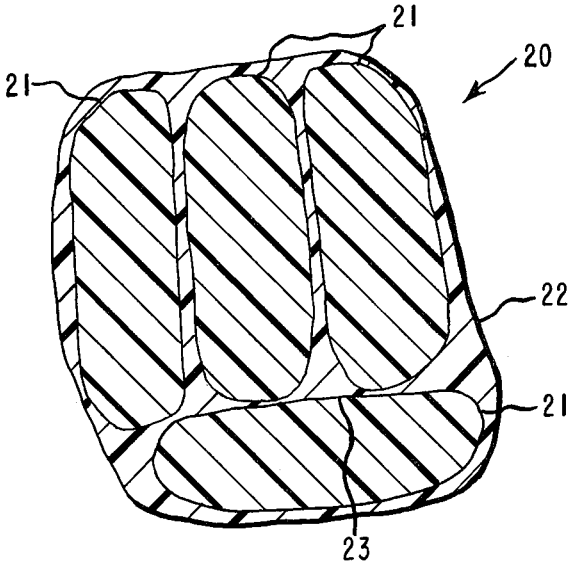

FIGS. 2, 3 and 4 are end views of ply-twisted, bonded strings 20 of the invention which show in transverse cross-section monofilaments 21 of a synthetic thermoplastic polymer and having a substantially obround transverse cross-section. The monofilaments 21 are bonded together continuously along their lengths and surrounded by an adhesive resin 22. At least one flattened side 23 of each monofilament 21 is bonded to at least one adjacent monofilament. Because of their two, opposite, flattened sides, the monofilaments tend to align themselves, depending upon whether there are 2, 3 or 4 monofilaments, as shown in the Figures resulting in a substantially quadrilateral string cross-section having four flattened sides and four rounded corners.

DESCRIPTION OF THE INVENTION

The use of large monofilaments having flattened sides for improved bonding in the strings of this invention reduces dependence on twist and the amount of adhesive resin required to obtain the desired degree of string integrity and durability. Lower twist and less adhesive resin can be used to advantage in improving string properties and performance as well as to reduce cost of preparation. The best bonding is obtained when a flattened side of one monofilament is bonded to the flattened side of an adjacent monofilment, or to several other monofilaments as the odd monofilament in FIG. 4. For strings containing more than two monofilaments, at least one of the monofilaments should have two flattened sides bonded to each of two adjacent monofilaments, for example as a sandwiched middle monofilament with two opposite flattened sides as shown in FIG. 3.

Preferred monofilaments for the strings of this invention have a cross-section (taken at right angles to the filament axis) with two, opposite, substantially flattened (including flat) sides, which includes for instance such known cross-sectional shapes as ribbon, oblong, obround and equivalent variations thereof where the flattened sides are only slightly curved. Such cross-sections generally have the shape of two opposite, long sides with rounded edges or rounded ends, the length-to-width ratio of the cross-section preferably being within the range of from 2 to 4. By this invention these monofilaments have been found to provide racket strings having an improved combination of handling, tensile and playing properties and which can be easily manufactured.

A particularly useful cross-section length-to-width ratio range for oriented, melt-spun monofilaments is from about 2.3 to 3.0 because of the outstanding combination of handling and of tensile properties attainable in both monofilament and string. Monofilaments, particularly within the higher end of the length-to-width range, may be prepared by known methods of slitting oriented film, such monofilaments having a more truly flat-sided cross-section.

Because of their shape, the preferred monofilaments more readily tend to align themselves along their flattened sides within the string cross-section to improve bonding. The resulting cross-sections of strings made from two to four of such monofilaments generally have a quadilateral-, or a rectilateral-like shape. This four-sided shape in the ply-twisted configuration of the bonded string improves gripping of the ball by the racket strings upon contact as compared to a more rounded string cross-section.

Strings of this invention particularly suitable for use in squash and tennis rackets have a total denier (exclusive of adhesive) of about 8,000 to about 18,000 with each monofilament having a denier of about 2,000 to 8,000. Within these ranges individual players may prefer different deniers according to their skill and personal preference. For a string containing three monofilaments each monifilament appropriately may have a denier of about 3,000 to 4,200. With two monofilaments, each monofilament preferably has a denier of from 4,000 to 7,000. To simplify preparation all monofilaments in the string preferably have substantially the same denier and cross-section.

The strings of this invention require only a relatively small amount of ply-twist to obtain the necessary properties for subsequent handling and use. Contrary to more conventional string and cordage ply-twisting methods, wherein the strands to be plied are first twisted individually in one direction followed by ply-twisting in the opposite twist direction, the individual monofilaments for this invention must be substantially free of individual twist to provide the desired proper alignment of the monofilaments after plying. The relatively high twist levels commonly employed in strings and cords from multifilament yarns are not required for this invention and preferably are avoided. A ply-twist level within the range of about 1 to 3 turns per inch (0.4 to 1.2 turns per cm) is preferred. This low level of twist, and being only ply-twist, greatly reduces the time and expense of the twisting operation for string preparation, as compared to more highly twisted strings and also results in better retention of tensile properties upon converting from monofilament to string since such properties can be adversely affected by high twist. Conventional up-twist or down-twist apparatus may be used for the twisting operation. In some instances it may be necessary to modify the manner of feeding the monofilaments to the twisting zone to facilitate or maintain proper aligment of the monofilaments with one another during twisting.

To complete preparation of the string, the ply-twisted monofilaments are bonded together by the application of an adhesive resin or by another method, such as with heat or a solvent to plasticize the surface of the monofilaments and permit mutual adhesion. The use of an adhesive resin for bonding is preferred. Whereas some prior known strings require very heavy and/or numerous applications of such resins, the strings of this invention generally require no more than about 35% by weight of the string of the adhesive, with 25 to 35% being quite typical. For this invention, the adhesive resin serves primarily to bond the filaments together, both to facilitate handling properties such as when stringing a racket and to permit the string to function as an integral unit, with each monofilament acting integrally with the other monofilaments. Although the resin may and will normally coat the outer surface of the string, such surface coating is of secondary importance; this frequently is not the case in strings of the prior art which contain many smaller surface filaments which are much more subject to fraying from surface abrasion as compared to the heavy monofilaments used in this invention. However, lubricating agents can also be employed beneficially for this invention as known in the art to improve string life in use. Such agents can be applied with the adhesive or by separate application to the monofilaments or string. Of course, a lubricant must be chosen which does not disrupt the bonding.

The particular bonding agent or method to be employed of course depends upon the polymer from which the monofilaments are made. Both solvent based and aqueous latex based adhesives can be employed, as known in the trade. For polyamide monofilaments, polyurethane based resins marketed for polyamide adhesive applications have been found to be suitable. Normally in association with the bonding treatment, the ply-twisted monofilaments will be heated, which also heat-sets the twist. Heating conditions may also be selected to obtain the desired string tensile properties which may require heating under tension or under relaxation. The heating may occur in several stages with the first stage being before or after the application of any adhesive. For highly oriented polyamide monofilaments as employed in the following examples, a thermal relaxation of the ply-twisted string prior to bonding has been found to improve the impact resistance of the string.

Whereas the preferred monofilaments of this invention having two opposite flattened sides normally tend to align themselves along their flattened sides during a ply-twisting as shown in FIGS. 2, 3 and 4, when three monofilaments are ply-twisted under conditions where each is fed to the twisting zone at the identically same, controlled rate, they can align themselves along their edges to form a triangular string cross-section having a central triangular void along the string. Such triangular string configurations can be obtained by using a down-twister and feeding the monofilaments to the twisting zones at equal tensions and speeds and using no more tension in the twisting zone than is necessary to operate. Such strings, although useful for some applications, do not have the high degree of integrity and separation resistance as do the strings of this invention.

Strong, tough, oriented, synthetic polyamide monofilaments particularly suitable for this invention, and methods for their preparation, are described in U.S. Pat. No. 3,650,884 to Hansen and in British patent specification No. 1,430,449. Such monofilaments, as the result of a steam treatment to improve their knot strength, have a surface sheath which is either disoriented or less oriented than the monofilament core. The monofilaments however may be comprised of any oriented, synthetic thermoplastic polymer having sufficient tensile properties for the intended use. Such polymers include polyethylene, polypropylene, polyesters and polyamides. Polymers particularly preferred for their good tensile properties where high strength and toughness are required are the synthetic polycarbonamides, commonly referred to as nylons, and particularly poly(hexamethylene adipamide), 6—6 nylon, and poly(ε-caproamide), 6-nylon, with a relative viscosity above 60.

The term "oriented polymer" means that the polymer molecules have been molecularly oriented by stretching to improve polymer strength and toughness as is well known in the art of preparing synthetic filaments.

Good bonding in the strings of this invention is readily reflected in a reduced tendency for the monofilaments to separate and/or break during stringing of a racket. If one of the monofilaments should break during use, the good bonding inhibits strip back of the broken end which facilitates repair and replacement of the broken string.

MONOFILAMENT PREPARATION

Poly(hexamethylene adipamide), 6—6 nylon, monofilaments of obround cross-section for Examples I and II below are prepared in general accordance with the method exemplified and taught by Gauntt et al. in British Pat. No. 1,430,449. The nylon polymer having a relative viscosity of 70 (as defined in Gauntt et al.) is melt spun through a rectangular spinneret orifice having rounded corners, the spun filament is attenuated in an air gap below the spinneret and then immediately quenched in water at about 30° C for a distance of 544 cm. The monofilament is then first stage drawn through a pressurized steam chamber 76 cm. in length and second stage drawn while making three passes through a 122-cm. long radiant heating zone, followed by a 2% relaxation. Key process conditions employed, as well as properties of the monofilaments, are as follows:

| | Monofil. for Example I | Monofil. for Example II |
|---|---|---|
| Orifice dimensions, mm. | 10.97 × 3.86 | 9.58 × 3.10 |
| Air gap distance, cm. | 56 | 69 |
| Feed roll surface speed, mpm | 93.2 | 132 |
| Steam pressure, Kg/cm² | 9.14 | 8.44 |
| First stage draw | 4.2X | 4.1X |
| Temp. of radiant heat zone | 1100° C. | 1050° C. |
| Total Draw Ratio | 5.85X | 5.75X |
| Monofilament denier | 4200 (4666 dtex) | 3000 (3333 dtex) |
| Dimensions of monofil, Cross-section, mm. | 1.13 × 0.43 | 0.94 × 0.35 |
| (length-to-width ratio) | (2.64:1) | (2.7:1) |
| Tenacity | 9.72 gpd 8.58 dN/tex* | 9.73 gpd 8.59 dN/tex |
| Break Elongation | 19.6% | 16.0% |
| Loop Tenacity | 3.7 gpd 3.3 dN/tex | 4.4 gpd 3.9 dN/tex |
| Loop Elongation | 9.4% | 9.6% |

*Decinewtons/tex.

EXAMPLE I

Three cylindrical packages of the above untwisted, obround monofilament were mounted upon the let-off stands of a turntable uptwister as shown in FIG. 1. With the turntable rotating at 84 rpm, the monofilaments were pulled upward and combined with adjacent flattened sides as in FIG. 3 to form a ply-twisted string at the rate of 34.9 inches (88.6 cm) per minute takeoff speed and passed at the same speed to a pair of input rolls. The string was then passed four times through a vertically aligned curing furnace having an inside diameter of 1.5 inches (3.8 cm) and a length of 1.48 meters, the first and second passes through the furnace being preceded by immersion of the string in a coating bath comprised of an aqueous dispersion (25% solids) of a nonionic polyurethane adhesive (Latex X-1042, BASF Wyandotte Corp., Wyandotte, Mich). The wall of the curing furnace was maintained at a temperature of about 270° C. After the second pass, no more adhesive was applied. After the fourth pass through the furnace, the dried and bonded cured string was passed around a pair of exit rolls at a speed of 32.1 inches (81.5 cm) per min., so that a relaxation of 8.7% occurred between the input rolls and the exit rolls. The string was wound up at the same speed as the exit roll speed. The properties of "Test String I" are listed in Table I.

EXAMPLE II

Four cylindrical packages of the previously described, untwisted, 6—6 nylon, obround monofilament (3000 denier) were mounted separately on let-off stands designed to produce even tension between stands, and the four monofilaments were fed to a standard tire cord type downtwister at the rate of 28.8 ypm (26.3 mpm) to combine them into a string and impart a ply-twist of 2.4 turns per inch (0.94 turns per cm). The monofilaments align themselves as in FIG. 4. The spindle package of ply-twisted string was placed on a commercial machine for coating tire cord and the string was bonded with an aqueous dispersion (25% solids) of the polyurethane adhesive of Example I by passing the string into and out of a first dip pan of adhesive, through an oven maintained at 210° C. while relaxing the cord 12%, into and out of a second dip pan of adhesive, and then again through a 210° C oven (no relaxation on this pass) to cure the cord. The properties of "Test String II" are also listed in Table I.

TABLE I

| | Test String I | Test String II |
|---|---|---|
| Denier* | 14,729 (16366 dtex) | 16,026 (17807 dtex) |
| Twist | 2.6 t.p.inch(1.03 t.p.cm) | 2.4 t.p.inch(0.94 t.p.cm) |
| Tenacity | 6.45 g.p.den(5.69 dN/tex) | 5.28 g.p.den(4.66 dN/tex) |
| Break Elong. | 22.3% | 33.6% |
| Initial Modulus | 37.4 g.p.den(33.0 dN/tex) | 22.6 g.p.den(19.9 dN/tex) |
| Break Load | 210 lb. (95 Kg) | 186 lb. (84.4 Kg) |
| Elongation Properties At 60 lb(27.2 kg)Load: | | |
| Elongation | 8.5% | 13.5% |
| lb./1%ΔE | 8.9 | 6.3 |
| kg./1%ΔE | 4.0 | 2.9 |

*Including Adhesive.

The ability of a tennis string to undergo deflection during play while it is strung under tension in a racket is measured by the property Δlb/1%ΔE (ΔKg/1%ΔE) at 60 lb (27.2 Kg) load. This property, also designated as the "Tangent Modulus" at 60 lb. (27.2 Kg) load, simply measures the additional load required to elongate the string 1% when it is already under a load of 60 lb. (27.2 Kg). An elongation of 1% is about the maximum which can be obtained in a string already under tension in a racket during an exceptionally hard drive or serve. The best gut strings are characterized by consistently low tangent modulus values, ranging from about 6.7 to 7.9 lb. (3.0 to 3.6 Kg.) per 1% elongation at 60 lb (27.2 Kg) load. Strings having higher tangent modulus values are usually characterized as "boardy". The tangent values of strings of the present invention are similar to gut and give relatively low shock during play.

EXAMPLE III

Player reaction to the strings of Examples I and II is determined as follows:

Commercially available tennis rackets ("Headmaster", manufactured by Head Ski Division of AMF, Inc.) were strung with the following strings.

Test String I

Test String II

Commercial Nylon String.

A commercially available tennis string comprised of a heavy central nylon monofil surrounded by a single layer consisting of 11 smaller nylon monofils ("Blue Spiral" Tennis string, manufactured by Toa Gosen, Japan).

Commercial Gut Spring

A commercially available tennis string composed of gut ("Victor Imperial Gut", manufactured by Victor Sports, Inc., Chicago).

Two sets of rackets were strung with each string. The two sets of rackets differed only in tension level within the range 46–58 lbs. (20.9–26.4 Kg) to provide a racket for each string at two levels of crispness. For the commercial strings, the stringing tensions were chosen within the range normally used for each by highly competent players. For the test strings of this invention, the tension levels were similarly selected to provide two optimum tensions at a relatively high and a relatively low level. See Table 2:

TABLE 2

| | Tension lbs. (kg) | |
|---|---|---|
| String | Low | High |
| I | 48(21.8) | 54(24.5) |
| II | 48(21.8) | 54(24.5) |
| Commercial Nylon | 46(20.9) | 52(23.6) |
| Commercial Gut | 52(23.6) | 58(26.4) |

The rackets were evaluated in play by five tennis players, each having had extensive tournament experience. Each player first evaluated each pair of rackets containing the same string and chose the racket having the tension level he preferred. He then evaluated his preferred racket containing Test String I in comparison with his preferred rackets containing the commercial tennis strings, and ranked them according to his preference of first (1), second (2) or third (3). The evaluation procedure was repeated for Test String II in comparison with the same commercial strings. The results are shown in Table 3.

TABLE 3

PREFERRED RANKING OF RACKETS

| | Test String I | Commercial Nylon String | Commercial Gut String |
|---|---|---|---|
| Player 1 | 1 | 2 | 3 |
| 2 | 2 | 3 | 1 |
| 3 | 2 | 3 | 1 |
| 4 | 1 | 3 | 2 |
| 5 | 1 | 3 | 2 |
| Sum of Rankings | 7 | 14 | 9 |
| Average Ranking | 1.4 | 2.8 | 1.8 |
| | Test String II | Commercial Nylon String | Commercial Gut String |
| Player 1 | 2 | 1 | 3 |
| 2 | 2 | 1 | 3 |
| 3 | 2 | 3 | 1 |
| 4 | 1 | 3 | 2 |
| 5 | 1 | 2 | 3 |
| Sum of Rankings | 8 | 10 | 12 |
| Average Ranking | 1.6 | 2.0 | 2.4 |

In both cases, the average ranking for the test string is better than that of either commercial string showing a high level of playability for these test strings of this invention.

EXAMPLE IV

Strings of this invention suitable for use in tennis rackets are prepared from the same 4200 and 3000 denier monofilaments of Examples I and II and in substantially the same manner as in Example I with exceptions of conditions as shown in Table 4. The adhesive employed is a commercial nylon resin which is an alcohol-soluble terpolymer of 6/66/610 nylon in the respective weight ratios of 43/34/23. The resin has a melting point of 157° C and a relative viscosity within the range of 70–90. The adhesive is applied from a 10% by weight solution in ethanol. The oven wall is maintained at a temperature of about 290°–292° C. The twister is run at 64 rpm.

TABLE 4

| | | | |
|---|---|---|---|
| Monofilaments: | | | |
| Denier | 4200 | 3000 | 4200 |
| Number | 3 | 3 | 2 |
| Treating Conditions: | | | |
| Feed Roll (cm/min) | 80.8 | 81.0 | 81.0 |
| Exit Roll (cm/min) | 68.6 | 66.3 | 66.9 |
| Nominal Twist (t/cm) | .93 | .97 | .96 |
| Nominal Overfeed (%) | 15.1 | 18.1 | 17.4 |
| Number Passes/Type | | | |
| #1 | Dry | Dry | Dry |
| #2 | Dip | Dip | Dip |
| #3 | Dip | Dip | Dip |
| #4 | Dry | Dip | Dip |
| String Properties: | | | |
| Den | 16024 | 12481 | 11644 |
| Tex | 1779 | 1385 | 1292 |
| Ten. (dN/tex) | 5.42 | 4.98 | 4.66 |
| Elong(%) | 38.5 | 39.5 | 40.4 |
| Initial Mod. (dN/tex) | 30.1 | 27.7 | 28.3 |
| Break Load (Kg) | 98.5 | 69.9 | 61.7 |
| At load: | | | |
| Elong (%) | 11.3 | 15.3 | 18.5 |
| ΔKg/1%ΔE | 2.7 | 4.2 | 1.8 |
| Impact Strength: | | | |
| Joules | 40.7 | 38.3 | 31.6 |

What is claimed is:

1. An integrated string comprised of from 2 to 4 monofilaments of an oriented, synthetic, thermoplastic polymer, with each monofilament having a denier of 2,000 to 8,000 and having at least two opposite flattened sides throughout its length, said monofilaments having substantially no individual twist and being ply-twisted and bonded together throughout the length of the string with each said monofilament being bonded along a flattened side to at least one other of said monofilaments.

2. A string of claim 1 comprised of 3 or 4 of said monofilaments wherein at least one of the monofilaments has two flattened sides along each of which is bonded a flattened side of one of the other monofilaments.

3. A string of claim 1 wherein each of said monofilaments has a substantially uniform cross-section along the monofilament and the cross-section has a length-to-width ratio of from 2 to 4.

4. A string of claim 3 wherein the monofilaments are bonded together by an adhesive resin which comprises less than about 35% by weight of the string.

5. A string of claim 3 having from about 0.4 to about 1.2 turns per cm. of ply-twist.

6. A string of claim 3 wherein said polymer is 66-nylon or 6-nylon.

7. A string of claim 3 wherein said cross-section is obround.

8. An integrated string consisting essentially of from 2 to 4 monofilaments of an oriented, synthetic polycarbonamide, with each monofilament having a denier of 2,000 to 8,000 and having throughout its length a substantially uniform cross-section with two opposite flattened sides and length-to-width ratio of from 2 to 4, said monofilaments having substantially no individual twist and being ply-twisted and bonded together throughout the length of the string with the ply-twist being from about 0.4 to about 1.2 turns per cm., and said monofilaments being aligned with each other so that each one is bonded along at least one of its flattened sides to at least one other of said monofilaments.

9. A string of claim 8 wherein said polymer is 66-nylon having a relative viscosity of at least 60.

10. A string of claim 8 wherein the monofilaments have a thin sheath of said polymer at the monofilament surface which is less oriented than the polymer in the monofilament core.

* * * * *